US007798353B2

(12) United States Patent
Blythe et al.

(10) Patent No.: US 7,798,353 B2
(45) Date of Patent: Sep. 21, 2010

(54) POLYMERIC CONTAINER ASSEMBLY WITH STACKABLE FEATURES

(75) Inventors: James S. Blythe, Libertyville, IL (US); Donald A. Lehman, Chicago, IL (US)

(73) Assignee: Pactiv Corporation, Lake Forest, IL (US)

( * ) Notice: Subject to any disclaimer, the term of this patent is extended or adjusted under 35 U.S.C. 154(b) by 701 days.

(21) Appl. No.: 11/602,612

(22) Filed: Nov. 21, 2006

(65) Prior Publication Data

US 2007/0114231 A1 May 24, 2007

Related U.S. Application Data

(60) Provisional application No. 60/739,990, filed on Nov. 23, 2005, provisional application No. 60/753,198, filed on Dec. 22, 2005.

(51) Int. Cl.
*B65D 41/18* (2006.01)

(52) U.S. Cl. ..... 220/4.24; 220/4.21; 206/509

(58) Field of Classification Search ..... 220/4.21, 220/4.24; 206/508, 509, 511
See application file for complete search history.

(56) References Cited

U.S. PATENT DOCUMENTS

| | | | |
|---|---|---|---|
| 2,627,991 | A | 2/1953 | Maersch |
| 2,798,631 | A | 7/1957 | Engel |
| 2,986,300 | A | 5/1961 | Parrish |
| 3,145,870 | A | 8/1964 | Lockwood |
| 3,704,779 | A | 12/1972 | Nigg |
| 3,902,540 | A | 9/1975 | Commisso |
| 3,938,726 | A | 2/1976 | Holden, Jr. et al. |
| 4,014,450 | A | 3/1977 | Girotti et al. |
| 4,201,301 | A | 5/1980 | Aggio |
| 4,307,817 | A | 12/1981 | Cotroneo |
| 4,360,118 | A | 11/1982 | Stern |
| 4,457,432 | A | 7/1984 | Solheim |

(Continued)

FOREIGN PATENT DOCUMENTS

| | | |
|---|---|---|
| BE | 740346 | 10/1969 |

(Continued)

OTHER PUBLICATIONS

English translation of Belgian Patent No. 740,346 dated Oct. 16, 1969 (8 pages).

(Continued)

*Primary Examiner*—Harry A Grosso
(74) *Attorney, Agent, or Firm*—Nixon Peabody LLP

(57) ABSTRACT

A generally circular container is disclosed. The container comprises a continuous body portion. The container further comprises a rim encompassing and projecting laterally outwardly from the body portion. The container further comprises a first feature projecting generally upwardly from the rim. The container further comprises a corresponding second feature positioned on the rim. The container further comprises a stacking feature formed on the body portion opposite the rim. The stacking feature extends substantially along the circumference of the container. The container is adapted to be stacked with a second container, the second container being inverted relative to the first container, by engaging the stacking feature of the container with a second stacking feature of the second container to prevent or inhibit lateral movement of the container relative to the second container.

22 Claims, 14 Drawing Sheets

U.S. PATENT DOCUMENTS

| | | | | |
|---|---|---|---|---|
| 4,458,825 | A | 7/1984 | Holota | |
| 4,930,636 | A | 6/1990 | Meadows | |
| 4,974,738 | A | 12/1990 | Kidd et al. | |
| 5,042,674 | A | 8/1991 | Ramsay et al. | |
| D339,741 | S | 9/1993 | Lorenz | |
| 5,310,070 | A | 5/1994 | Haas et al. | |
| 5,332,114 | A | 7/1994 | Sano et al. | |
| 5,377,860 | A | 1/1995 | Littlejohn et al. | |
| 5,992,679 | A | 11/1999 | Porchia et al. | |
| 7,032,773 | B2 | 4/2006 | Dees et al. | |
| 2003/0057207 | A1 | 3/2003 | Wong | |
| 2004/0144781 | A1 * | 7/2004 | Dees et al. | 220/4.24 |

FOREIGN PATENT DOCUMENTS

| | | |
|---|---|---|
| DE | 2349382 | 4/1975 |
| FR | 2 802 514 | 6/2001 |
| JP | 48-7205 | 2/1973 |
| JP | 51-81203 | 6/1976 |
| JP | 58-3456 | 1/1983 |
| JP | 59-11852 | 4/1984 |
| JP | 63-34069 | 3/1988 |
| JP | 63-62315 | 4/1988 |
| JP | 64-20462 | 2/1989 |
| JP | 2001002045 | 1/2001 |
| JP | 2002166951 | 6/2002 |
| WO | WO 92/09491 | 6/1992 |

OTHER PUBLICATIONS

International Search Report for Application No. 06061203 dated Jul. 19, 2007.

* cited by examiner

POLYMERIC CONTAINER ASSEMBLY WITH STACKABLE FEATURES

CROSS REFERENCE To RELATED APPLICATIONS

This application claims the benefit of U.S. Provisional Application No. 60/739,990, filed Nov. 23, 2005, and U.S. Provisional Application No. 60/753,198, filed Dec. 22, 2005, both of which are incorporated by reference in their entireties.

FIELD OF THE INVENTION

The present invention relates generally to containers. More particularly, the present invention relates to a polymeric container assembly with stackable features.

BACKGROUND OF THE INVENTION

The use of inexpensive polymeric, paper, or metal packaging containers has become popular, especially for preparing and serving various food products. Polymeric, paper, and metal containers generally have been used for heating the food product(s) disposed therein. These containers typically comprise a cover or lid and a base, which, when used together, form a container assembly.

The container assemblies are often stacked. Stacking the container assemblies allows a customer to carry or store several container assemblies at once. If the containers are transported and/or stored as container assemblies, stacking reduces the space required, which may subsequently reduce costs associated with transporting and/or storing the container assemblies. It is also desirable to prevent or inhibit shifting or sliding between adjacent stacked container assemblies that may potentially result in spilling the food product(s) stored within.

Thus, it would be desirable to have a container assembly that stacks efficiently so as to reduce the costs associated with transporting and/or storing the container assemblies. It would also be desirable to prevent or inhibit shifting or sliding between adjacent container assemblies.

SUMMARY OF THE INVENTION

According to one embodiment of the present invention, a container assembly is disclosed. The container assembly comprises a first generally circular container including a first continuous body portion and a first rim. The first rim encompasses and projects laterally outwardly from the first body portion. The first rim has a first feature projecting generally upwardly therefrom and a corresponding second feature. The first body portion forms a first stacking feature thereon. The first stacking feature and the first rim are located on generally opposite ends of the first container. The container assembly further comprises a second generally circular container including a second continuous body portion and a second rim. The second rim encompasses and projects laterally outwardly from the second body portion. The second rim has a third feature projecting generally upwardly therefrom and a corresponding fourth feature. The second body portion forms a second stacking feature thereon. The second stacking feature and the second rim are located on generally opposite ends of the second container. The first rim and the second rim are substantially identical. The first container and the second container are releasably engaged to each other by fitting the first upwardly-projecting feature into the fourth feature of the second container and by fitting the third upwardly-projecting feature into the second feature of the first container. The first and second stacking features extend substantially along the circumference of the corresponding first and second containers. The container assembly is adapted to be stacked on a second container assembly by engaging the first stacking feature of the container assembly with a second stacking feature of the second container assembly to prevent or inhibit lateral movement of the container assembly relative to the second container assembly.

According to another embodiment of the present invention, a container assembly is disclosed. The container assembly comprises a first generally polygonal container including a first continuous body portion and a first rim. The first rim encompasses and projects laterally outwardly from the first body portion. The first rim has a first feature projecting generally upwardly therefrom and a corresponding second feature. The first body portion forms a first stacking feature thereon. The first stacking feature and the first rim are located on generally opposite ends of the first container. The container assembly further comprises a second generally polygonal container including a second continuous body portion and a second rim. The second rim encompasses and projects laterally outwardly from the second body portion. The second rim has a third feature projecting generally upwardly therefrom and a corresponding fourth feature. The second body portion forms a second stacking feature thereon. The second stacking feature and the second rim are located on generally opposite ends of the second container. The first rim and the second rim are substantially identical. The first container and the second container are releasably engaged to each other by fitting the first upwardly-projecting feature into the fourth feature of the second container and by fitting the third upwardly-projecting feature into the second feature of the first container. The first and second stacking features extend substantially along at least two sides of the corresponding first and second containers. The container assembly is adapted to be stacked on a second container assembly by engaging the first stacking feature of the container assembly with a second stacking feature of the second container assembly to prevent or inhibit lateral movement of the container assembly relative to the second container assembly.

According to another embodiment of the present invention, a method of stacking container assemblies is disclosed. The method comprises the act of providing a first generally circular container assembly including a first container and a second generally circular container. The first container has a first continuous body portion and a first rim. The first rim encompasses and projects laterally outwardly from the first body portion. The first rim has a first feature projecting generally upwardly therefrom and a corresponding second feature. The first body portion forms a first stacking feature thereon. The first stacking feature extend substantially along the circumference of the first container. The first stacking feature and the first rim are located on generally opposite ends of the first container. The second container includes a second continuous body portion and a second rim. The second rim encompasses and projects laterally outwardly from the second body portion. The second rim has a third feature projecting generally upwardly therefrom and a corresponding fourth feature. The second body portion forms a second stacking feature thereon. The second stacking feature extends substantially along the circumference of the second container. The second stacking feature and the second rim are located on generally opposite ends of the second container. The first rim and the second rim are substantially identical. The first container and the second container are releasably engaged to each other by fitting the first upwardly-projecting feature into the fourth feature of the second container and by fitting the third upwardly-projecting feature into the second feature of the first container. The method further comprises the act of providing a second container assembly including a generally circular third container and a fourth generally circular container. The third container has a third continuous body portion and a third rim. The third rim encompasses and projects laterally outwardly from the third body portion. The third rim has a fifth feature projecting generally upwardly therefrom and a corresponding sixth feature. The third body portion forms a third stacking feature thereon. The third stacking feature extends substantially along the circumference of the third container. The third stacking feature and the third rim are located on generally opposite ends of the third container. The fourth container includes a fourth continuous body portion and a fourth rim. The fourth rim encompasses and projects laterally outwardly from the fourth body portion. The fourth rim has a seventh feature projecting generally upwardly therefrom and a corresponding eighth feature. The fourth body portion forms a fourth stacking feature thereon. The fourth stacking feature extends substantially along the circumference of the fourth container. The fourth stacking feature and the fourth rim are located on generally opposite ends of the fourth container. The third rim and the fourth rim are substantially identical. The third container and the fourth container are releasably engaged to each other by fitting the fifth upwardly-projecting feature into the eighth feature of the fourth container and by fitting the sixth upwardly-projecting feature into the seventh feature of the third container. The method further comprises the act of positioning the first container assembly and the second container assembly such that the second and third containers are adjacent to each other. The method further comprises the act of engaging the first stacking feature of the first container assembly with the fourth stacking feature of the second container assembly to prevent or inhibit lateral movement of the first container assembly relative to the second container assembly.

According to another embodiment of the present invention, a method of stacking container assemblies is disclosed. The method comprises the act of providing a first generally polygonal container assembly including a first container and a second generally polygonal container. The first container has a first continuous body portion and a first rim. The first rim encompasses and projects laterally outwardly from the first body portion. The first rim has a first feature projecting generally upwardly therefrom and a corresponding second feature. The first body portion forms a first stacking feature thereon. The first stacking feature extends substantially along at least two sides of the first container. The first stacking feature and the first rim are located on generally opposite ends of the first container. The second container includes a second continuous body portion and a second rim. The second rim encompasses and projects laterally outwardly from the second body portion. The second rim has a third feature projecting generally upwardly therefrom and a corresponding fourth feature. The second body portion forms a second stacking feature thereon. The second stacking feature extends substantially along the at least two sides of the second container. The second stacking feature and the second rim are located on generally opposite ends of the second container. The first rim and the second rim are substantially identical. The first container and the second container are releasably engaged to each other by fitting the first upwardly-projecting feature into the fourth feature of the second container and by fitting the third upwardly-projecting feature into the second feature of the first container. The method further comprises the act of providing a second container assembly including a generally polygonal third container and a fourth generally polygonal container. The third container has a third continuous body portion and a third rim. The third rim encompasses and projects laterally outwardly from the third body portion. The third rim has a fifth feature projecting generally upwardly therefrom and a corresponding sixth feature. The third body portion forms a third stacking feature thereon. The third stacking feature extends substantially along at least two sides of the third container. The third stacking feature and the third rim are located on generally opposite ends of the third container. The fourth container includes a fourth continuous body portion and a fourth rim. The fourth rim encompasses and projects laterally outwardly from the fourth body portion. The fourth rim has a seventh feature projecting generally upwardly therefrom and a corresponding eighth feature. The fourth body portion forms a fourth stacking feature thereon. The fourth stacking feature extends substantially along at least two sides of the fourth container. The fourth stacking feature and the fourth rim are located on generally opposite ends of the fourth container. The third rim and the fourth rim are substantially identical. The third container and the fourth container are releasably engaged to each other by fitting the fifth upwardly-projecting feature into the eighth feature of the fourth container and by fitting the sixth upwardly-projecting feature into the seventh feature of the third container. The method further comprises the act of positioning the first container assembly and the second container assembly such that the second and third containers are adjacent to each other. The method further comprises the act of engaging the first stacking feature of the first container assembly with the fourth stacking feature of the second container assembly to prevent or inhibit lateral movement of the first container assembly relative to the second container assembly.

According to another embodiment of the present invention, a method of stacking container assemblies is disclosed. The method comprising the act of providing a first generally circular container assembly including a first generally circular container and a second generally circular container. The first container has a first continuous body portion and a first rim. The first rim encompasses and projects laterally outwardly from the first body portion. The first rim has a first feature projecting generally upwardly therefrom and a corresponding second feature. The first body portion forms a first stacking feature thereon. The first stacking feature extends substantially along the circumference of the first container. The first stacking feature and the first rim are located on generally opposite ends of the first container. The second container includes a second continuous body portion and a second rim. The second rim encompasses and projects laterally outwardly from the second body portion. The second rim has a third feature projecting generally upwardly therefrom and a corresponding fourth feature. The second body portion forms a second stacking feature thereon. The second stacking feature extends substantially along the circumference of the second container. The second stacking feature and the second rim are located on generally opposite ends of the second container. The first rim and the second rim are substantially identical. The first container and the second container are releasably engaged to each other by fitting the first upwardly-projecting feature into the fourth feature of the second container and by fitting the third upwardly-projecting feature into the second feature of the first container. The method further comprises the act of providing a second container assembly including a generally polygonal third container and a fourth generally polygonal container. The third container has a third continuous body portion and a third rim. The third rim encompasses and projects laterally outwardly from the third body portion.

The third rim has a fifth feature projecting generally upwardly therefrom and a corresponding sixth feature. The third body portion forms a third stacking feature thereon. The third stacking feature extends substantially along at least two sides of the third container. The third stacking feature and the third rim are located on generally opposite ends of the third container. The fourth container includes a fourth continuous body portion and a fourth rim. The fourth rim encompasses and projects laterally outwardly from the fourth body portion. The fourth rim has a seventh feature projecting generally upwardly therefrom and a corresponding eighth feature. The fourth body portion forms a fourth stacking feature thereon. The fourth stacking feature extends substantially along at least two sides of the fourth container. The fourth stacking feature and the fourth rim are located on generally opposite ends of the fourth container. The third rim and the fourth rim are substantially identical. The third container and the fourth container are releasably engaged to each other by fitting the fifth upwardly-projecting feature into the eighth feature of the fourth container and by fitting the sixth upwardly-projecting feature into the seventh feature of the third container. The method further comprises the act of positioning the first container assembly and the second container assembly such that the second and third containers are adjacent to each other. The method further comprises the act of engaging the first stacking feature of the first container assembly with the fourth stacking feature of the second container assembly to prevent or inhibit lateral movement of the first container assembly relative to the second container assembly.

According to another embodiment of the present invention, a generally circular container is disclosed. The container comprises a continuous body portion. The container further comprises a rim encompassing and projecting laterally outwardly from the body portion. The container further comprises a first feature projecting generally upwardly from the rim. The container further comprises a corresponding second feature positioned on the rim. The container further comprises a stacking feature formed on the body portion opposite the rim. The stacking feature extends substantially along the circumference of the container. The container is adapted to be stacked with a second container, the second container being inverted relative to the first container, by engaging the stacking feature of the container with a second stacking feature of the second container to prevent or inhibit lateral movement of the container relative to the second container.

According to another embodiment of the present invention, a generally polygonal container is disclosed. The container comprises a continuous body portion. The container further comprises a rim encompassing and projecting laterally outwardly from the body portion. The container further comprises a first feature projecting generally upwardly from the rim. The container further comprises a corresponding second feature positioned on the rim. The container further comprises a stacking feature formed on the body portion opposite the rim. The stacking feature extends substantially along at least two sides of the container. The container is adapted to be stacked with a second container, the second container being inverted relative to the first container, by engaging the stacking feature of the container with a second stacking feature of the second container to prevent or inhibit lateral movement of the container relative to the second container.

The above summary of the present invention is not intended to represent each embodiment or every aspect of the present invention. Additional features and benefits of the present invention are apparent from the detailed description and figures set forth below.

DESCRIPTION OF ILLUSTRATED EMBODIMENTS

Figure 1A:
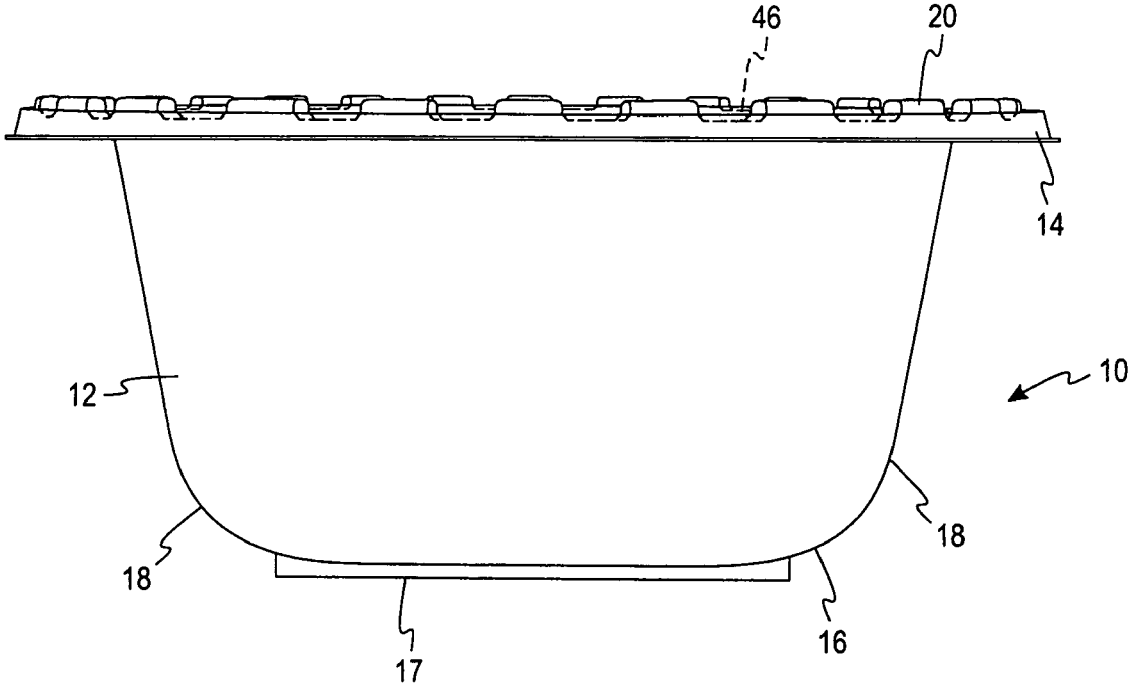
FIG. 1*a* is a side view of a first container to be used in a container assembly according to one embodiment of the present invention.

Referring to FIGS. 1*a,b*, a container (e.g., first container 10) to be used in one embodiment of the present invention is shown. Although the containers used in the illustrated embodiments are bowls, it is also contemplated that other container assemblies may be formed. For example, container assemblies may be formed, but are not limited to, using plates, bowls, platters, tubs, single-serve and family-size containers, single-serve and family-size ovenware, and combinations thereof. One such combination is a bowl and a plate that forms a container assembly. The remainder of the figures will show containers and container assemblies with respect to bowls, although it is recognized by one of ordinary skill in the art that other container assemblies, such as those discussed above, may be formed.

The height and shape of the container assembly may vary from that shown without departing from the scope of the invention. For example, the containers of the illustrated embodiments are depicted as being generally circular or rectangular. It is contemplated that the container assemblies and containers used herein may be other shapes such as square, hexagonal, octagonal, other polygonal shapes, or oval.

The container assemblies of the present invention are typically used with respect to food, but may be used in other applications such as with medical applications, cosmetics, or other items. Food container assemblies may be used for serving, storing, preparing, and/or re-heating the food.

Referring back to FIGS. 1*a,b*, the first container 10 includes a continuous body portion 12 and a continuous rim 14 encompassing and projecting laterally outwardly from the body portion 12. The body portion 12 includes a bottom 16 having a stacking feature and a continuous sidewall 18 encompassing and projecting upwardly and outwardly from the bottom 16. It is contemplated that the sidewall 18 may project only upwardly from the bottom 16 or even project upwardly and inwardly from the bottom 16. It is also contemplated that the rim 14 may not be continuous, although it is desirable that it be continuous.

The rim 14 includes a first upwardly-projecting feature projecting generally upwardly from the rim 14 and a corresponding second feature (e.g., a space created between adjacent upwardly-projecting features). In the embodiment of FIGS. 1*a,b*, the first upwardly-projecting feature includes a plurality of ribs 20. The ribs 20 are spaced apart with a corresponding plurality of spaces 46 being formed therebetween. The ribs 20 may be formed in different patterns than shown in FIG. 1*a* with respect to the rim 14. It is contemplated that the number of ribs 20 may vary from that shown in FIG. 1*a* depending on factors such as the size or shape of the container assembly, the material(s) type and thickness of the container assembly, and the desired holding strength of the container assembly.

It is contemplated that the shape and size of the ribs 20 may vary from that shown in FIG. 1*a*. It is desirable that the ribs 20 be shaped and sized to minimize the stacking height of the containers used to form container assemblies. It is desirable to minimize the stacking height of the containers to (a) reduce transportation costs and packaging and (b) provide space efficiency in retail and consumer settings. It is also desirable to maximize the holding strength of the container assembly. The desired holding strength is often a balance between making the container assembly easy for a consumer to open and close while still preventing or inhibiting an inadvertent opening of the container assembly.

It is contemplated that the first upwardly-projecting features may be shaped differently than the ribs 20 shown in FIG. 1*a*. In the embodiment of FIG. 1*a*, the ribs 20 generally include a top surface or generally flat area. Similarly, the spaces 46 include a bottom surface or generally flat area. Alternatively, the first upwardly-projecting features may be a plurality of round, oval, square, or polygonal features.

Figure 2A:
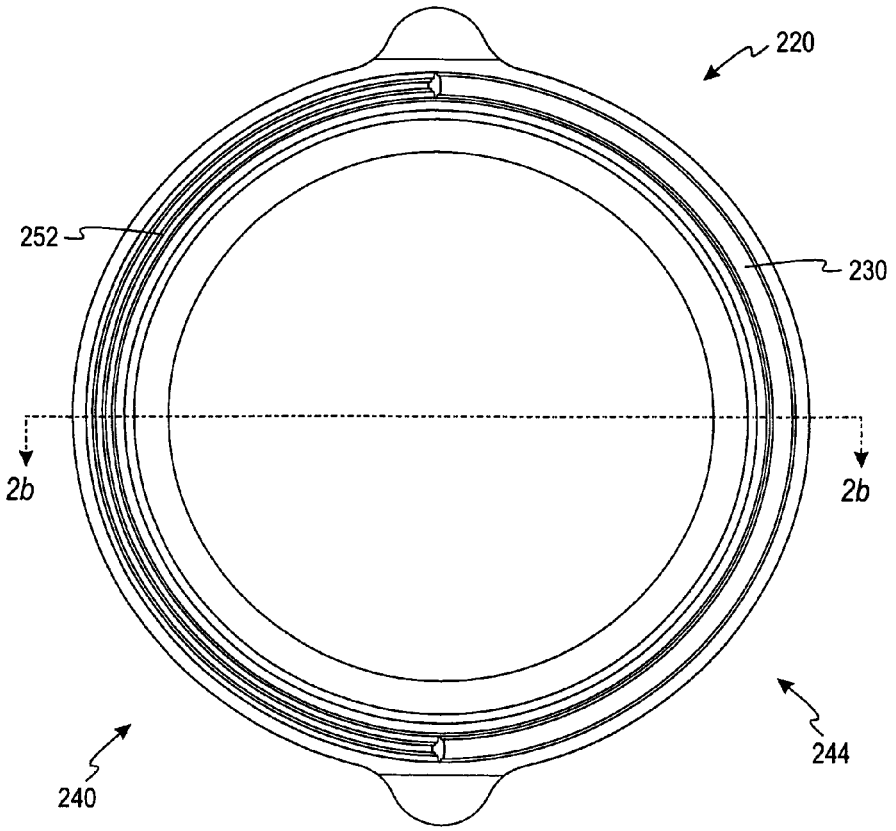
FIG. 2*a* is a top view of a container having a rib and groove to be used in a modular container assembly according to one embodiment.
Figure 2B:
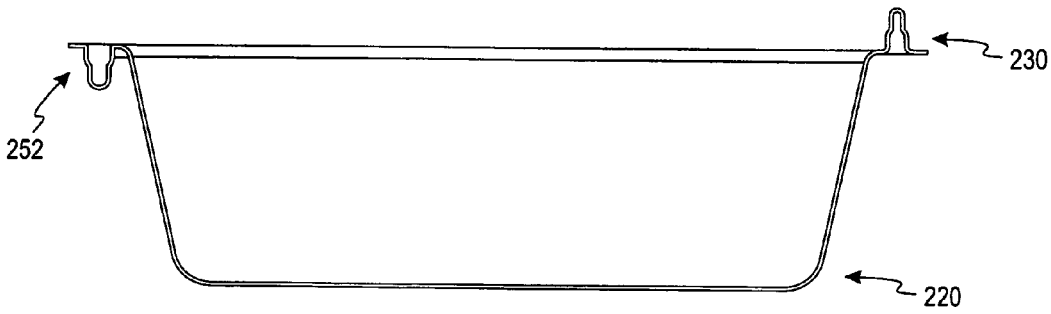
FIG. 2*b* is a cross-sectional view of the container of FIG. 2*a* taken generally across line 2*b*-2*b* of FIG. 2*a*.
Figure 2C:
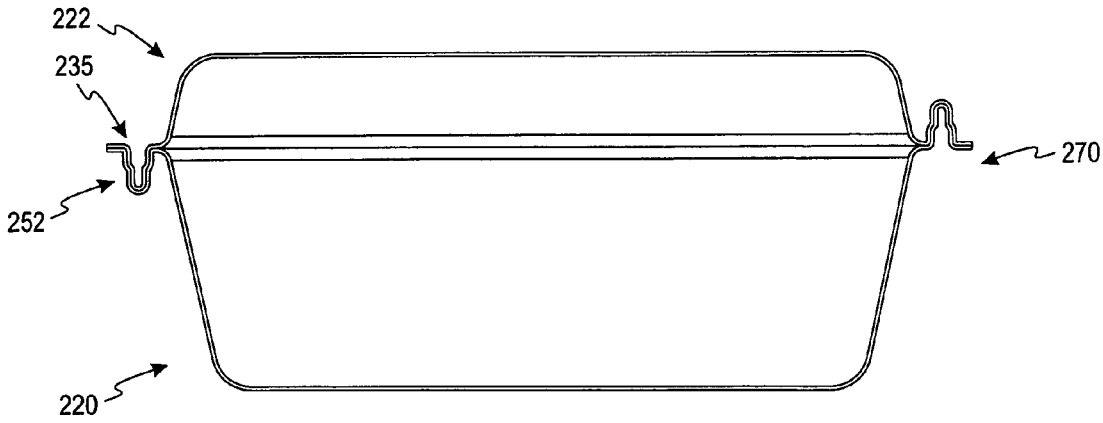
FIG. 2*c* is a side view of a container assembly using the container of FIGS. 2*a-b* and a second container having substantially the same rib and groove structure.

It is contemplated that many shapes and sizes may be formed by the upwardly-projecting features used in the present invention. It is also contemplated that releasably engaging features other than the ribs 20 and spaces 46 may be used. For example, a rib and groove structure may be used to form a container assembly. An example of a rib and groove structure is shown in FIGS. 2*a-c*. Referring to FIGS. 2*a-b*, a rib 230 extends generally around about one-half of the circumference 244 of a container 220, and a groove 252 is formed around the remainder of the circumference 240 of the container 220. FIG. 2*b* is a cross-sectional view of the container 220 of FIG. 2*a* taken generally along line 2*b*-2*b*. FIG. 2*c* shows a container assembly 270 using the container 220 of FIGS. 2*a-b* and a second container 222 having substantially the same rib and groove structure. The groove 252 of the container 220 releasably engages a second rib 235 of the second container 222. The second rib 235 extends into the entire interior of the groove 252. It is contemplated that a rib may extend into substantially the entire interior of the groove.

Referring back to FIGS. 1*a,b*, according to the present invention, a stacking feature is formed on the bottom 16 of the first container 10. The stacking feature generally includes a raised area and a corresponding recessed area, which typically is a space created by or surrounding the raised area. Alternatively, the stacking feature may include a plurality of raised areas and corresponding recessed areas. According to the present invention, the stacking feature extends substantially across at least two sides of a polygonal container or substantially along the circumference of a circular or oval container.

Figure 1B:
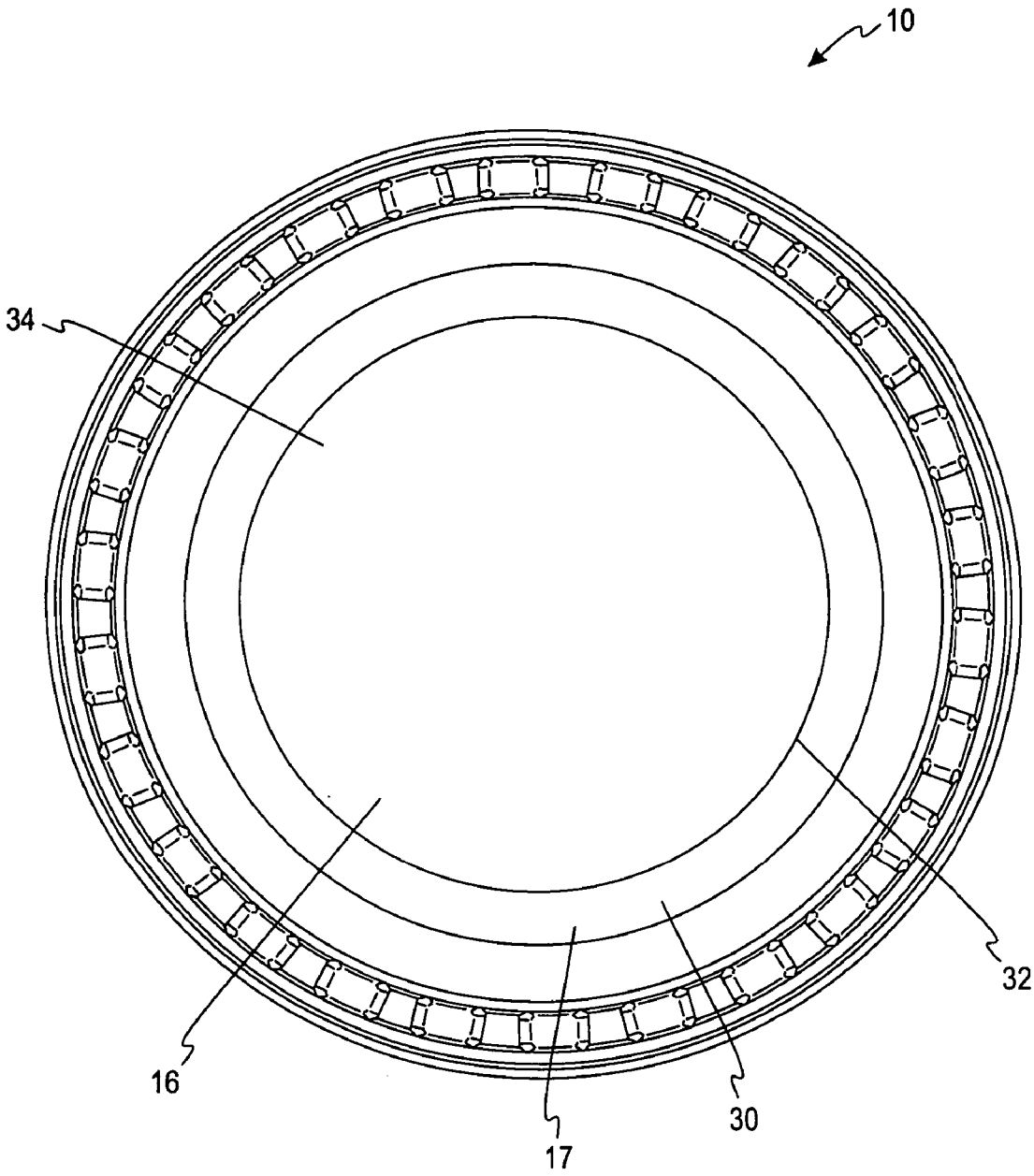
FIG. 1*b* is a bottom view of the first container of FIG. 1*a*.

The first container 10 of FIG. 1*a* illustrates a raised area 17 according to one embodiment of the present invention. FIG. 1*b* is a bottom view of the first container 10. The raised area 17 of this embodiment is in the shape of a raised ring 30 extending near or along the circumference of the circular bottom 16. The corresponding recessed area is in the shape of a recessed circle 34 having a diameter equal to an inner diameter 32 of the raised ring 30.

Figure 3:
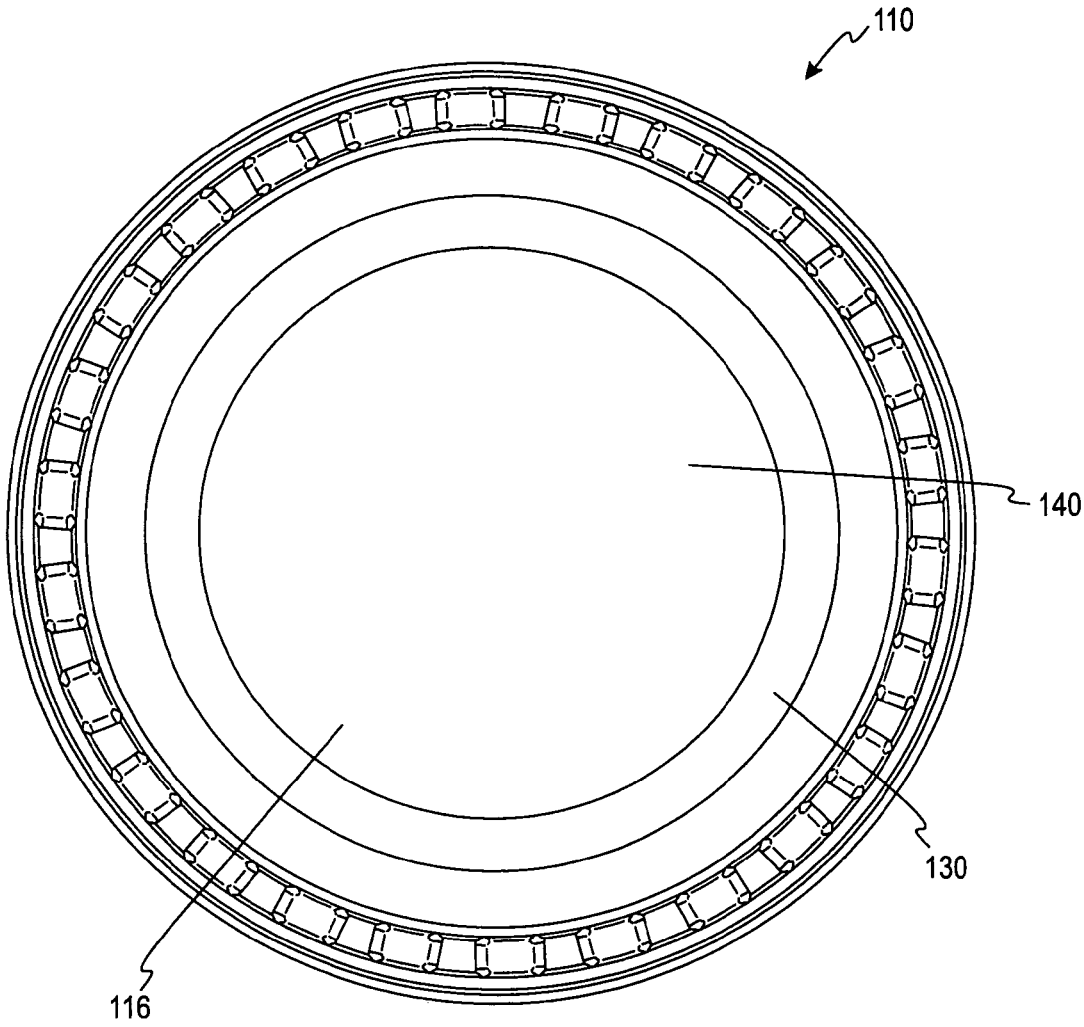
FIG. 3 is a bottom view of a second container to be used in a container assembly according to one embodiment.

FIG. 3 shows a perspective bottom view of a second container 110 adapted to be stacked with the first container 10 of FIGS. 1*a,b*. In this embodiment, a second bottom 116 of the second container 110 may include a raised circle 140 having a diameter of substantially the same size as the inner diameter 32 of the raised ring 30 and a corresponding recessed ring 130. Thus, the containers 10, 110 may be stacked such that the raised circle 140 fits within the raised ring 30. Alternatively, the second container 110 may have other types of raised areas adapted to fit within the raised ring 30 of the first container 10 so as to prevent or inhibit lateral movement of the first container 10 with respect to the second container 110. For example, the raised area of the second container 110 may be in the shape of a second ring (not shown) having an outer diameter of substantially the same size as the inner diameter 32 of the raised ring 30. The raised area of the second container 110 may also be in the shape of a plurality of arches positioned to fit within and contact the raised ring 30 of the first container 10. Other types of raised areas suitable for preventing or inhibiting lateral movement of the stacked containers are also contemplated.

It is contemplated that the shape and size of the stacking features may vary from those shown in FIGS. 1*b* and 3. It is preferred that the raised and recessed areas be shaped and sized to minimize the stacking height of the containers. It is also desirable to maximize the holding strength of the stacked container assembly. It may be desirable for the raised area to be of generally the same size and dimensions as the corresponding recessed area to inhibit or prevent lateral movement of one container assembly relative to the other container assembly.

Figure 7:
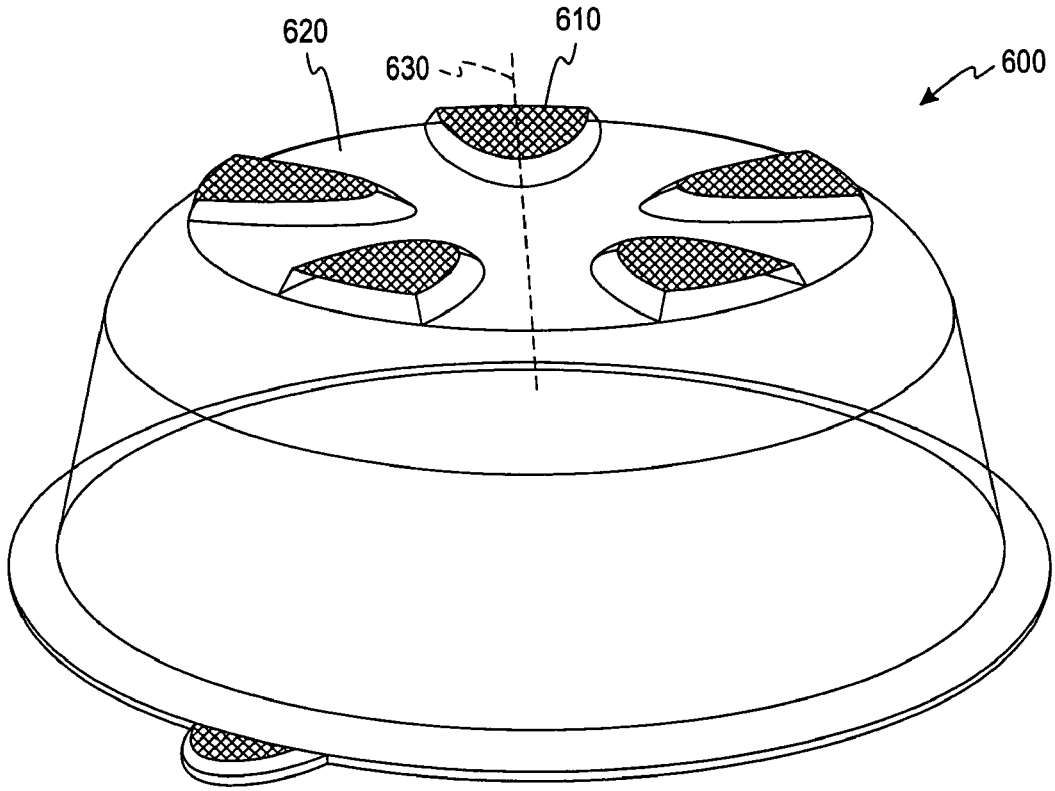
FIG. 7 is a bottom perspective view of a container having a stacking feature according to a sixth embodiment of the present invention.
Figure 12:
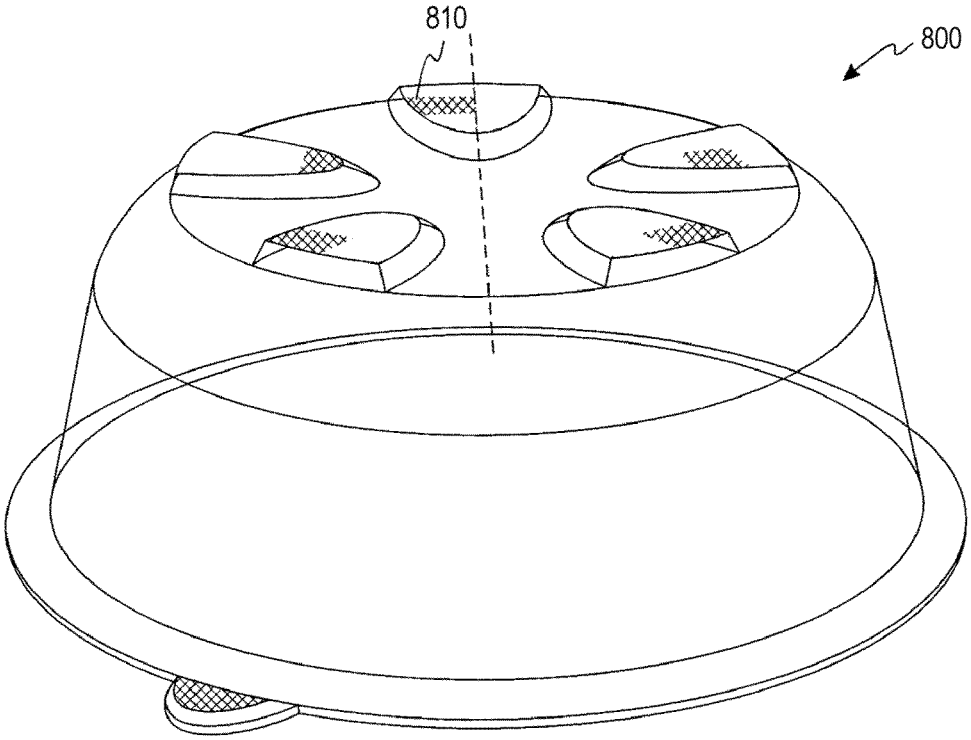
FIG. 12 illustrates a bottom perspective view of a container having a stacking feature according to another embodiment of the present invention.

It is also contemplated that the raised and recessed areas may be in the form of other shapes including, but not limited to rectangular, square, hexagonal, octagonal, other polygonal shapes, or oval. The raised and recessed areas may also include, respectively, ribs or a plurality thereof and the spaces formed thereby. In another embodiment, the stacking feature includes textured surfaces, where the height difference between the raised and recessed areas is slight relative to each other. The textured surfaces may have a uniform pattern (as shown in FIG. 7), or they may be random (e.g., the randomly-textured surface 810 of container 800 of FIG. 12).

In another embodiment of the present invention, the stacking features of the first container 10 and the second container 110 are substantially identical. Having substantially identical stacking features on adjacent top and bottom container surfaces is desirable because it eliminates the need to match a container having a first stacking feature to a second container having a corresponding second stacking feature, thus promoting ease and efficiency in stacking.

FIGS. 4-8 are bottom perspective views of containers having stacking features that allow a first container assembly to be stacked with another container assembly having a substantially identical stacking feature according to several embodiments. The stacking features include a plurality of raised areas and the spaces formed therebetween. The stacking features extend substantially along at least two sides of a polygonal container or substantially along the circumference of a circular or oval container. This is desirable so that, when stacking, a user need only rotate the containers slightly to fit the stacking feature of one container within the stacking feature of the other container.

Figure 4:
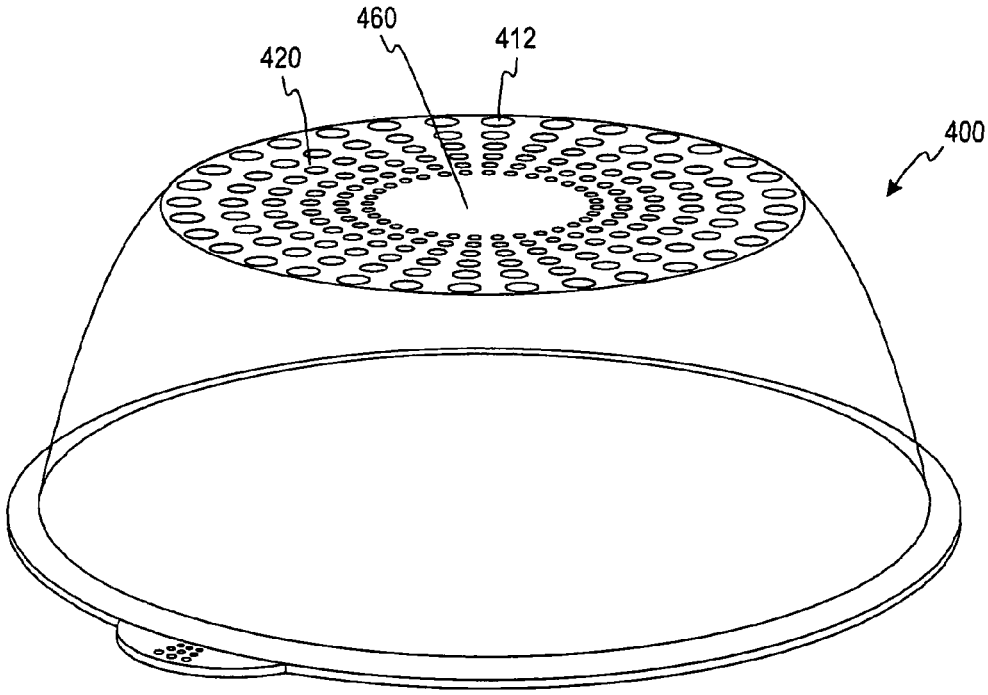
FIG. 4 is a bottom perspective view of a container having a stacking feature according to a third embodiment of the present invention.

According to the embodiment of FIG. 4, a stacking feature of a container 400 includes a plurality of uniformly spaced circular raised areas 412. The circular raised areas 412 are symmetric from the center of the container 460. The circular raised areas 412 extend substantially along the circumference of the container 400 and are arranged so as to form spaces 420 therebetween. The spaces 420 are appropriately sized to receive identical circular raised areas of another container. In the embodiment of FIG. 4, the area surrounding the center 460 of the container 400 does not include the stacking feature. This may be desirable so that other features may be included in this area, including, but not limited to, a company name or logo.

Figure 5A:
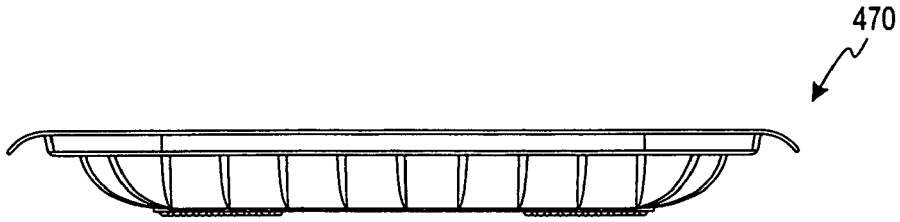
FIG. 5*a* is a side view of a container having a stacking feature according to a fourth embodiment of the present invention.
Figure 5B:
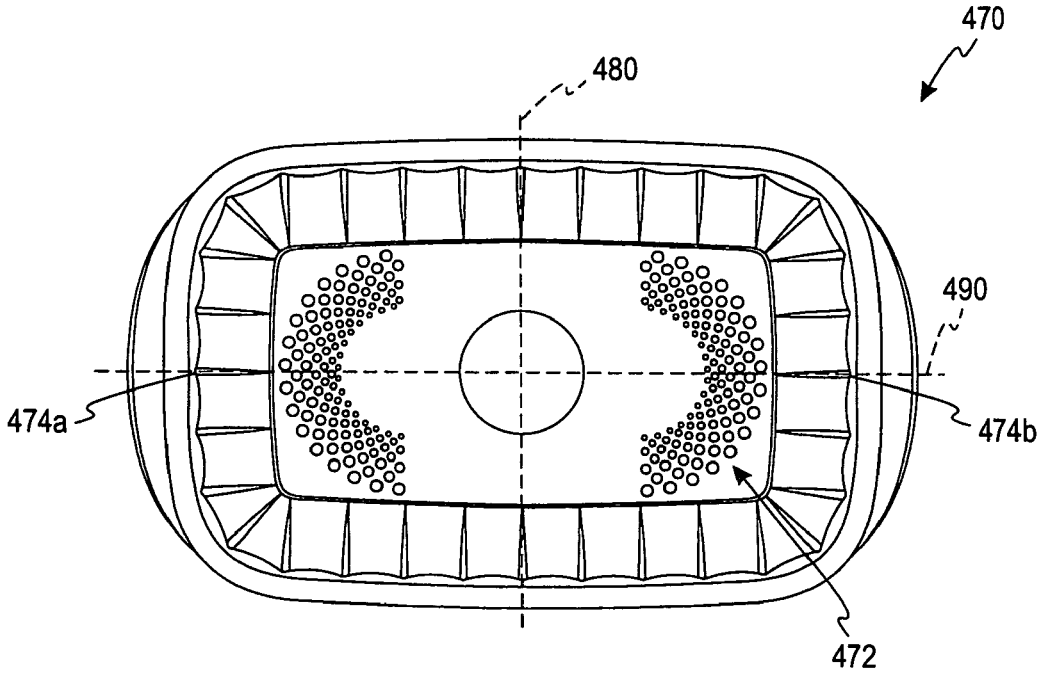
FIG. 5*b* is a bottom view of the container of FIG. 5*a*.

In the embodiment of FIGS. 5*a,b*, the stacking feature of a rectangular container 470 includes a plurality of circular raised areas 472 similar to those of FIG. 4. The circular raised areas 472 are symmetric with respect to a generally vertical line 480 or a generally horizontal line 490 running through the center 485 of the container 470. The circular raised areas 472 extend substantially along two sides 474*a,b* of the rectangular container 470. It is desirable that the stacking feature extend substantially along at least two opposite sides 474*a,b*, thus making it easier to match the stacking feature of one container with the stacking feature of another container.

Figure 6:
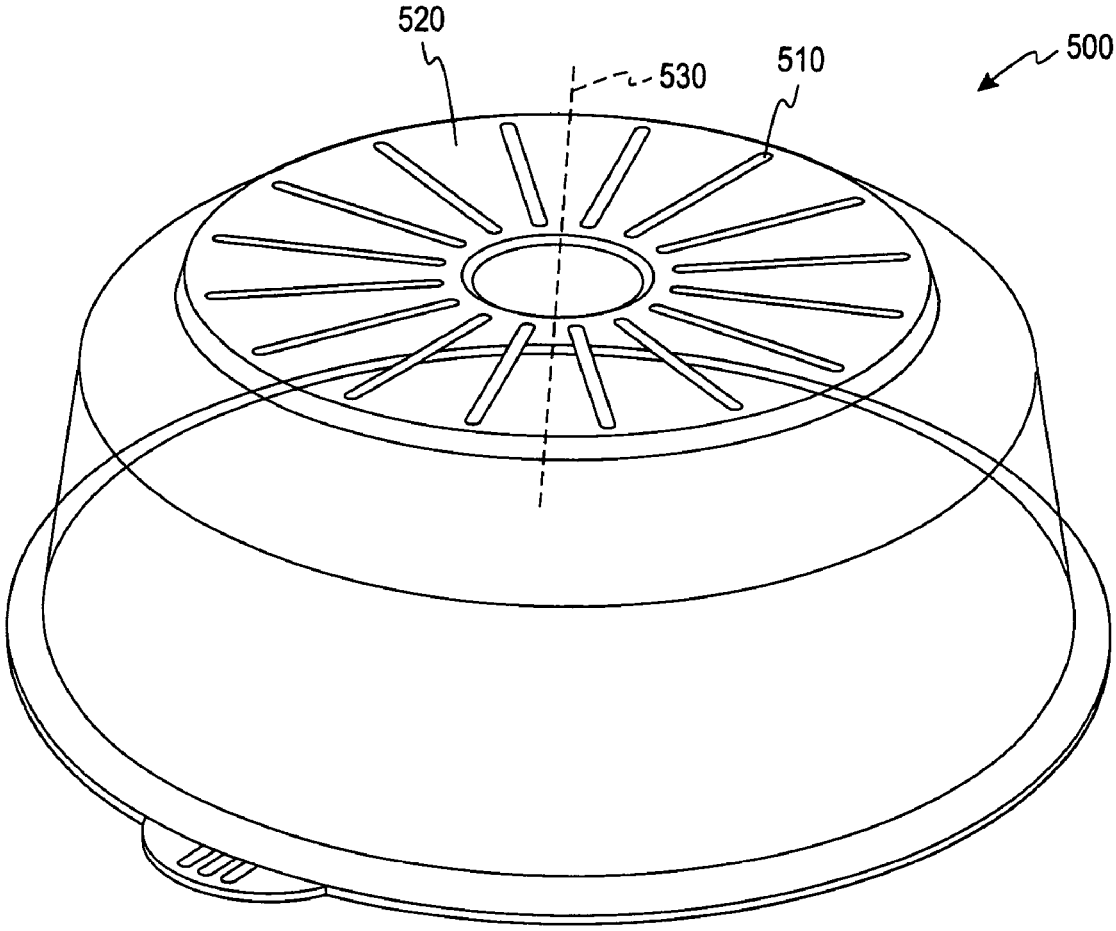
FIG. 6 is a bottom perspective view of a container having a stacking feature according to a fifth embodiment of the present invention.

In the embodiment of FIG. 6, a container 500 has a stacking feature including raised lines 510 positioned symmetrically with respect to a generally vertical line 530 running through the center 540 of the container 500. The raised lines 510 project radially from the center or near the center of the container 500. The raised lines 510 are arranged substantially along the circumference of the container and positioned so that there is a sufficient amount of space 520 therebetween for an identical raised line of another container to fit within the space 520 so that the bottoms of the two containers fit together so as to prevent or inhibit movement of one container with respect to the other container.

In the embodiment of FIG. 7, a container 600 has a stacking feature including a plurality of curved raised areas 610. The curved areas 610 extend substantially along of the circumference of the bottom of the container 600 and are symmetric with respect to a generally vertical line 630 running generally through the center of the container 600. The curved raised areas 610 are spaced such that an identical curved raised area located on the bottom of another container may fit in a corresponding space 620 formed therebetween so that the bottoms of the two containers fit together so as to prevent or inhibit movement of one container with respect to the other container.

Figure 8:
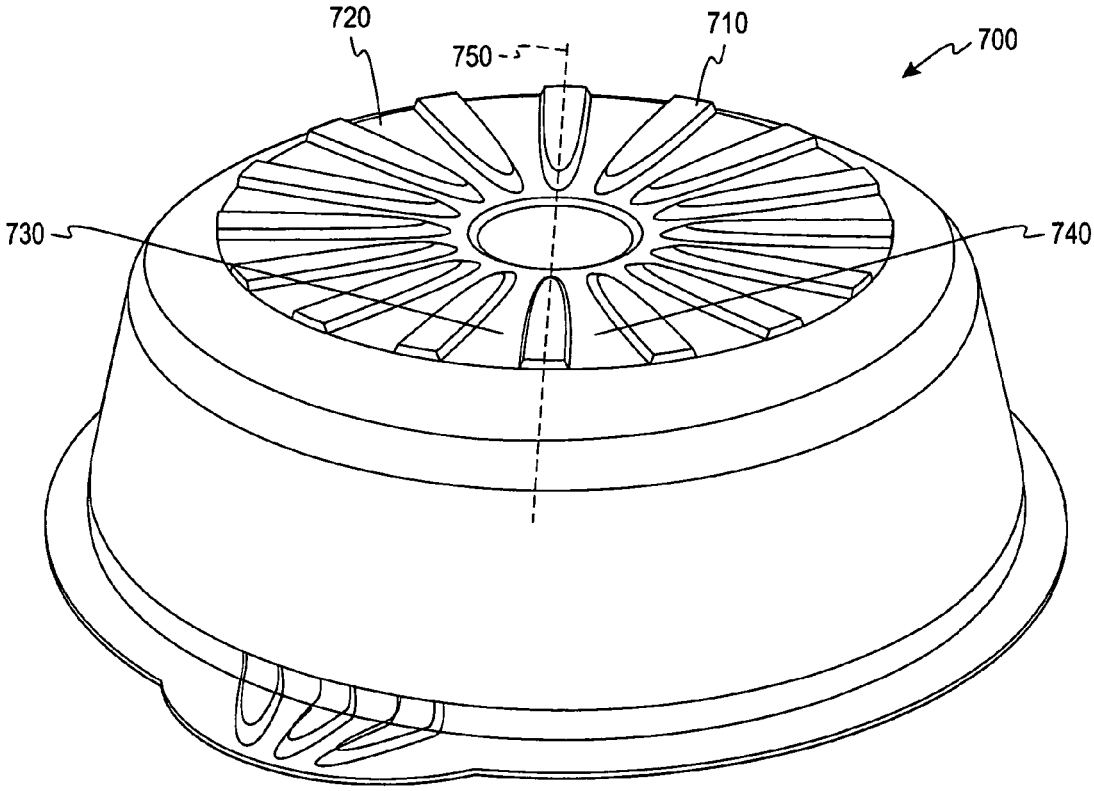
FIG. 8 is a bottom perspective view of a container having a stacking feature according to a seventh embodiment of the present invention.

FIG. 8 shows a container 700 having a stacking feature including a plurality of narrow curved raised areas 710. The narrow curved raised areas 710 are symmetric with respect to a generally vertical line 750 running generally through the center of the container 700 and extend substantially along of the circumference of the bottom of the container 700. The narrow curved raised areas 710 are spaced such that an identical narrow curved raised area located on the bottom of another container may fit in a corresponding space 720 formed therebetween so that the bottoms of the two containers fit together so as to prevent or inhibit movement of one container with respect to the other container.

Figure 9:
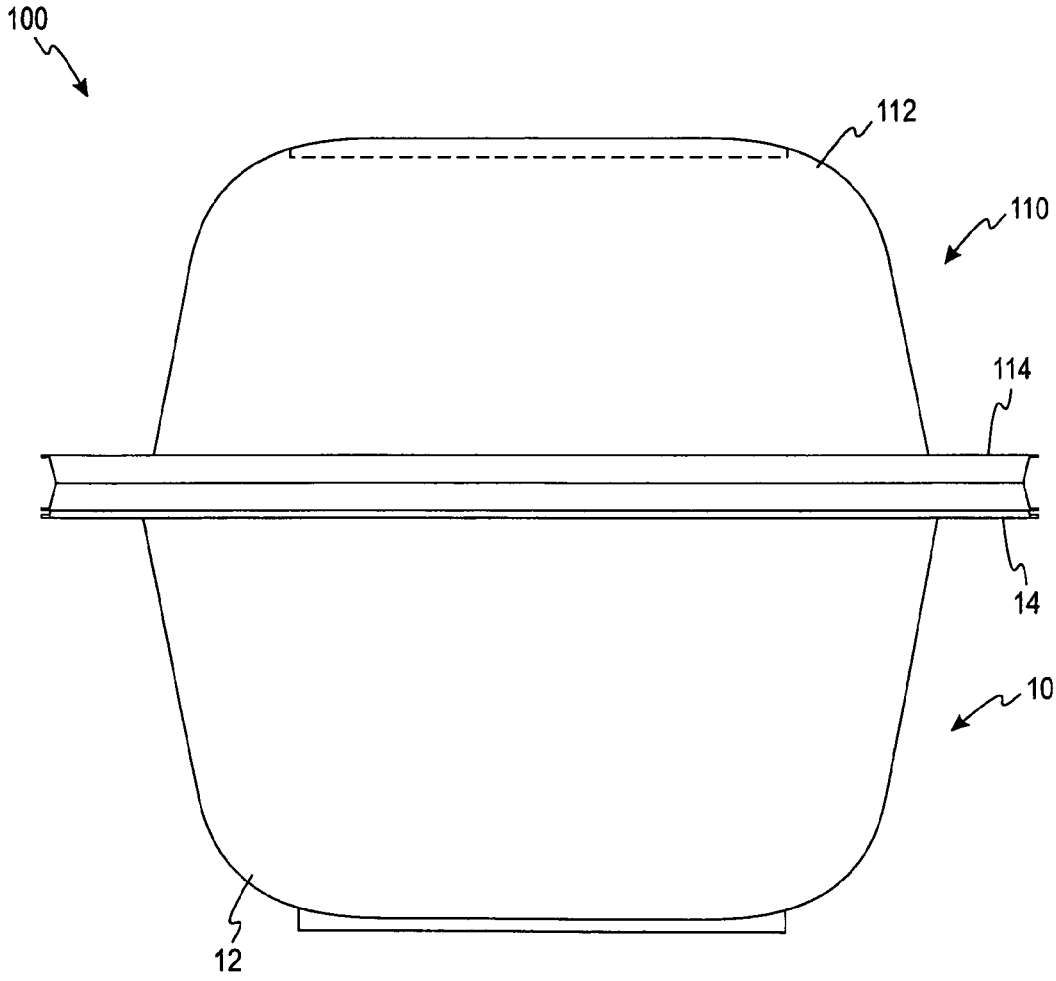
FIG. 9 is a side view of a container assembly using the containers of FIGS. 1*a,b* and 3.

A container assembly 100 according to one embodiment of the present invention is depicted in FIG. 9. The container assembly 100 comprises the first container 10 of FIGS. 1*a,b* and the second container 110 of FIG. 3. As discussed above, the container assembly may be formed with different first and second containers than bowls.

Figure 10:
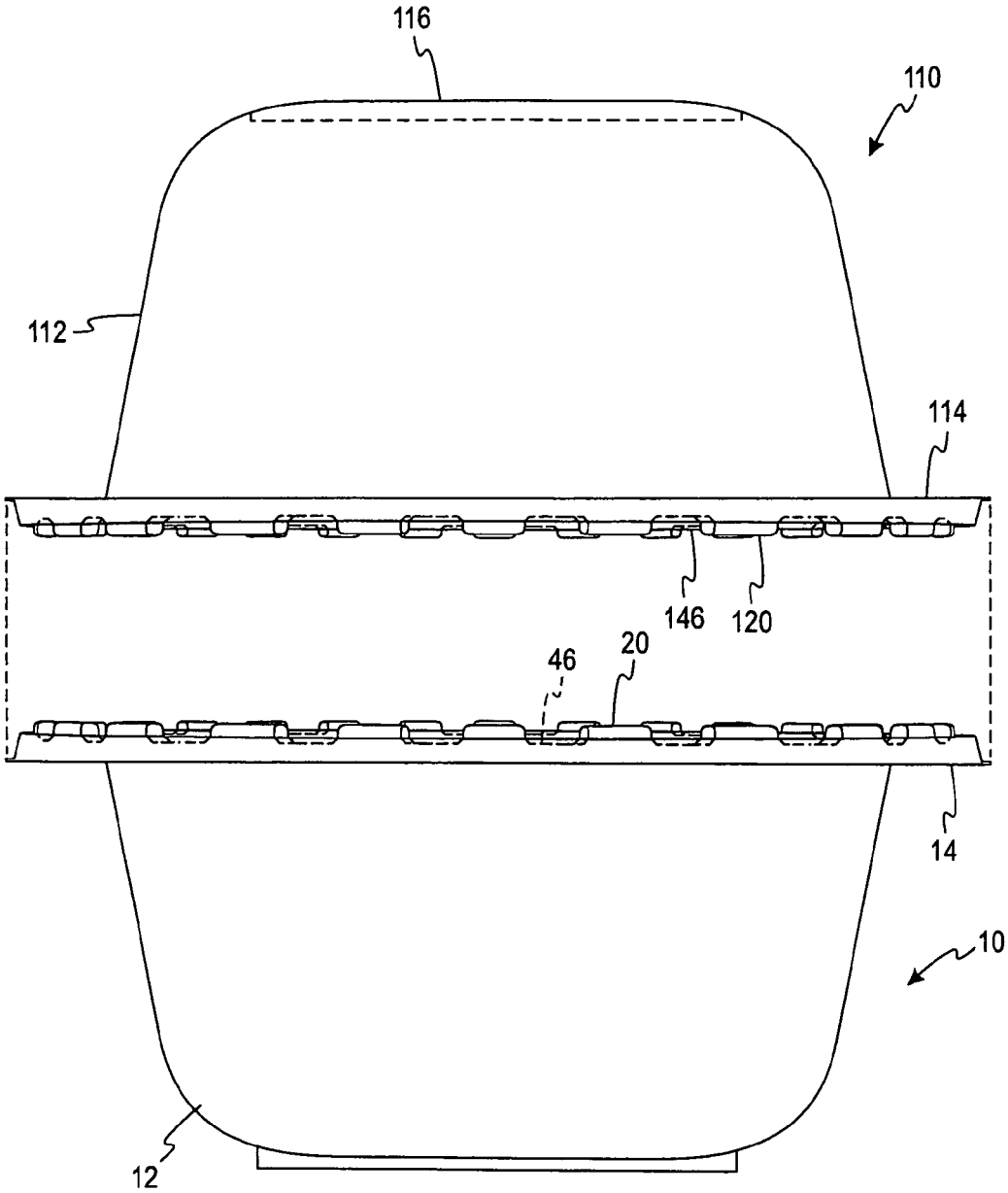
FIG. 10 is an exploded side view of the first and second containers to be used in forming the container assembly of FIG. 9.

According to one method, the container assembly 100 of FIG. 9 may be formed by assembling the first container 10 and the second container 110. The second container 110 includes a second continuous body portion 112 and a second continuous rim 114 that encompasses and projects laterally outwardly from the second body portion 112. As illustrated in FIG. 10, the second rim 114 also includes a second plurality of ribs 120 and a second plurality of spaces 146 formed therebetween. Each of the second plurality of ribs 120 may be shaped and sized similarly to the ribs 20 shown in FIG. 1*a*, projecting generally upwardly from the second rim 114 (i.e., in a direction away from the second continuous body portion 112). Similarly, the first container 10, as discussed above, includes the continuous body portion 12 and the continuous rim 14 that encompasses and projects laterally outwardly from the body portion 12 and includes a plurality of ribs 20 and spaces 46. The containers 10, 100 also include the stacking feature of FIGS. 1*b* and 3, respectively.

The second container 110 is flipped 180 degrees relative to the first container 10 such that the first container 10 and the second container 110 are generally aligned, and the rim 14 is adjacent to the second rim 114. This flipped position of second container 110 relative to the first container 10 is shown in FIG. 10. Referring to FIG. 10, the adjacent second ribs 120 of the second container 110 are fit into the respective spaces 46 of the first container 10, and the ribs 20 of the first container 10 are fit into the respective second spaces 120 of the second container 110 such that the container assembly 100 is releasably lockable. To fit the ribs of one container into respective spaces of the other container, one of the containers 10, 110 may have to be rotated slightly such that the ribs are offset (i.e., the ribs of one container and spaces of the other container are aligned). It is desirable that the consumer can assemble the containers 10, 110 so as to form a container assembly 100 of the present invention.

The strength of the lockable closure is dependent on many variables such as the number of the projecting ribs, the height of those ribs, whether undercuts are included, the size of the contact areas, the clearance needed between spaces and ribs, and the material(s) type and thickness used in forming the container assemblies. To improve the lockability of the container assembly an optional sealing feature may be added.

Figure 11:
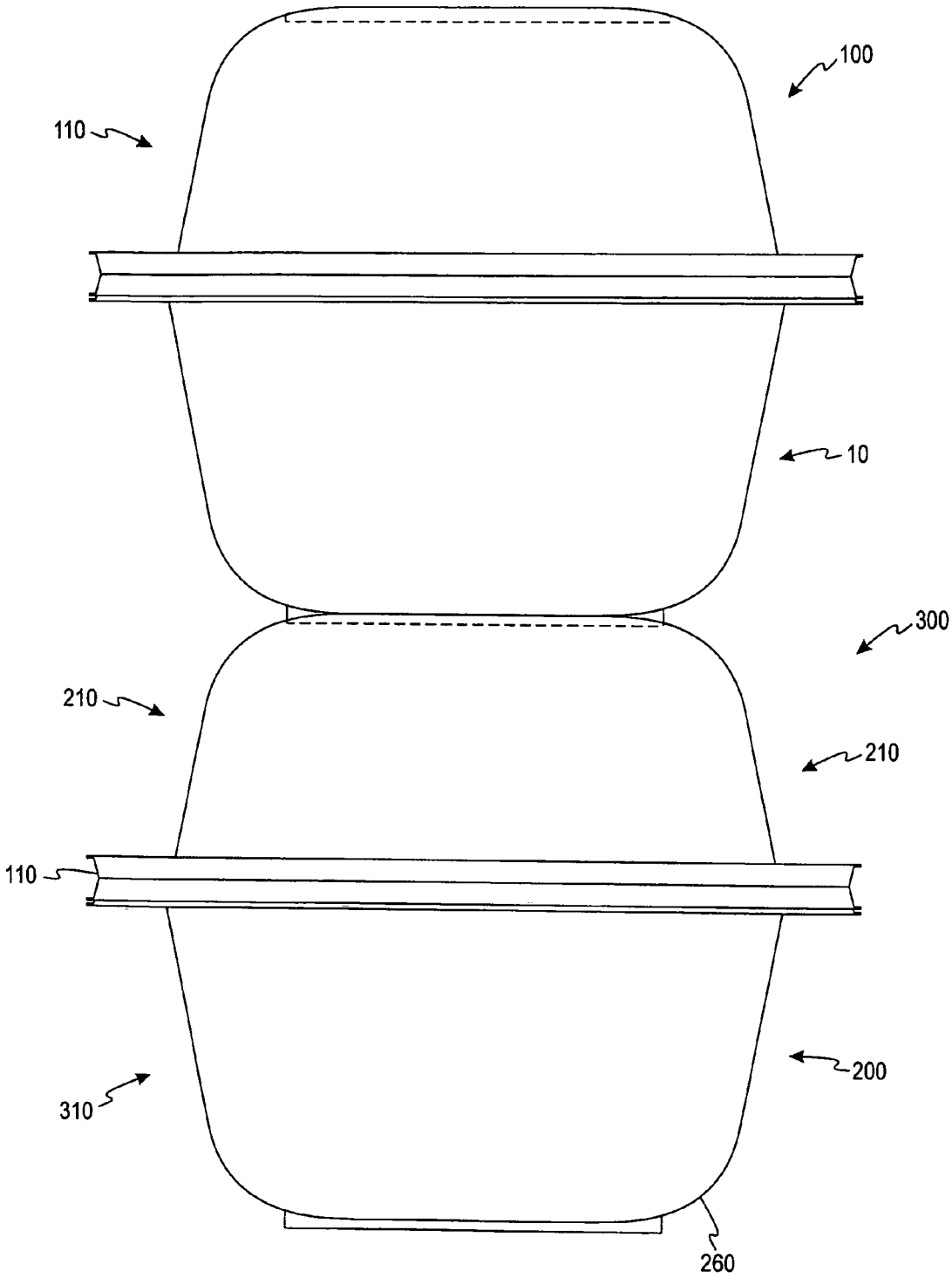
FIG. 11 is a side view of the container assembly of FIG. 9 and a second substantially identical container assembly of FIG. 9 in a stacked position.

FIG. 11 shows a stacked container assembly 300 of the present invention. The container assembly 100 of FIG. 9 is shown stacked on top of a second container assembly 200.

The second container assembly 200 is substantially identical or identical to the container assembly 100.

The stacked container assembly 300 of FIG. 11 may be formed according to one method by providing the first container assembly 100 and the second container assembly 200. The second container assembly includes a top container 210 and a bottom container 310 being releasably engageable at a rim area 250. The top container 210 has a stacking feature substantially identical to or identical to the stacking feature of the second container 110. The bottom container 310 has a stacking feature located on a bottom 260 that is substantially identical or identical to the stacking feature of the first container 10. The top and bottom containers 210, 310 may have a different shape from the containers 10, 110 of the container assembly 100. For example, the containers 210, 310 of the second container assembly 200 may be plates, bowls, platters, tubs, single-serve and family-size containers, single-serve and family-size ovenware, or combinations thereof.

According to one method, the stacked container assembly of FIG. 11 may be formed by generally aligning the container assembly 100 and the second container assembly 200 so that the stacking features of the first container 10 and the top container 210 are adjacent to each other. The raised area of the first container 10 is fit into a respective recessed area of the top container 210. It is contemplated that the second container assembly may have to be rotated slightly such that the raised area is offset (i.e., the raised area of the first container 10 and the recessed area of the top container 210 are aligned). It is desirable that the consumer can assemble the container assemblies 100, 200 so as to form a stacked container assembly 300 of the present invention.

Because the stacking features of the present invention are symmetric about a generally horizontal and/or vertical line and extend substantially along at least two sides of a polygonal container or substantially along the circumference of a circular or oval container, there are a variety of arrangements in which the stacking feature of one container may be combined with the stacking feature of another container. Referring back to FIG. 9, for example, the container 700 may be rotated so that a raised area 710 of one container may fit within any one of the spaces (i.e., 720, 730, 740, etc.) of a container with a substantially identical stacking feature. This is desirable so that, when stacking, a user need not rotate the container up to 180 degrees in order to match the stacking features of the two containers. Rather, the user need only rotate the containers slightly to fit one of the plurality of raised areas of one container into one of the plurality of spaces of another container so that the raised areas and the spaces are offset.

The container assemblies of the present invention are typically formed from polymeric materials but may be also formed from materials such as paper or metal. The polymeric containers may be formed from polyolefins. The polymeric food containers are typically formed from orientated polystyrene (OPS), polyethylene terephthalate (PET), polyvinyl chloride (PVC), polypropylene, and/or combinations thereof. The container assemblies may be made from a mineral-filled polymeric material such as, for example, talc or calcium carbonate-filled polyolefin. An example of paper that may be used in forming the container assemblies is paperboard or molded fiber. Paperboard and molded fiber typically have a sufficient coefficient of friction to maintain the first and second containers in a lockable position.

As discussed, the materials used in forming the container assembly may assist in releasably locking or stacking the container assemblies. For example, the material(s) forming the container assembly may have a fairly tacky laminate on one side that corresponds with a fairly tacky laminate on the opposing side, resulting in a desirable releasably lockable container assembly.

It is contemplated that the containers used in forming the container assemblies may be made from different materials. It is contemplated that one of ordinary skill in the art will recognize that other polymers or combination of polymers may be used to form the containers.

The container assemblies of the present invention are typically disposable, but it is contemplated that they may be reused at a future time. The containers used in forming the container assemblies (e.g., containers 10, 110) are shown as including one compartment. It is contemplated that the containers may be formed of multiple compartments. Such containers are desirable for placing items (e.g., food items) in different compartments to prevent or inhibit commingling of items. For example, undesirable mixing of food items can corrupt the flavor and the consistency of the food items.

As discussed above, the container assemblies may be used with food items. A method of using such container assemblies includes placing the food in a container and locking the containers to form a container assembly with the food therein. The container assembly is then placed in a heating apparatus and heated. Typical heating apparatuses include microwaves and conventional ovens. The container assemblies may contain solid food products. The container assemblies may be used for storage in the refrigerator and/or the freezer.

The containers to be used in forming the container assemblies of the present invention may be formed using conventional thermoforming (e.g., by pressure, vacuum, or the combination thereof), injection-molding processes, or rotational molding. According to one method of thermoforming, pellets of a polymeric resin and additives, if any, are added into an extruder. The pellets of the polymeric resin and additives, if any, are melted to form a blend. The blend is extruded through a die to form an extruded sheet. The extruded sheet is thermoformed to a desired shape of a container to be used in forming the container assembly.

The thickness of the container to be used in forming the container assemblies generally ranges from about 0.002 to about 0.15 inch, but is typically from about 0.005 to about 0.04 inch. The container assemblies may be opaque or a variety of colors or color combinations. The container assemblies typically have at least one transparent container if it is desired for the customer to ascertain the nature of the accommodated product and the condition thereof without having to open the container assembly.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A container assembly comprising:

a first generally polygonal container including a first continuous body portion and a first rim, the first rim encompassing and projecting laterally outwardly from the first body portion, the first rim having a first rib feature projecting generally upwardly around about one-half of the perimeter of the first container, and a corresponding first groove feature extending around the remaining about one-half of the perimeter of the first container, the first body portion forming a first stacking feature thereon, the first stacking feature including a plurality of first raised areas and a plurality of first spaces formed between adjacent first raised areas, the first stacking feature and the first rim being located on generally opposite ends of the first container; and a second generally polygonal container including a second continuous body portion and a second rim, the second rim encompassing and projecting laterally outwardly from the second body portion, the second rim having a second rib feature projecting generally upwardly around about one-half of the perimeter of the second container, and a corresponding second groove feature extending around the remaining about one-half of the perimeter of the second container, the second body portion forming a second stacking feature thereon, the second stacking feature including a plurality of second raised areas and a plurality of second spaces formed between adjacent second raised areas, the second stacking feature and the second rim being located on generally opposite ends of the second container, wherein the first rim and the second rim are substantially identical, wherein the first container and the second container are releasably engaged to each other by fitting the first upwardly-projecting rib feature into the second groove feature of the second container and by fitting the second upwardly-projecting rib feature into the first groove feature of the first container, wherein the first and second stacking features are symmetrically disposed along the corresponding first and second containers, and wherein the container assembly is adapted to be stacked on a second container assembly by engaging the first stacking feature of the container assembly with a third stacking feature of the second container assembly to prevent or inhibit lateral movement of the container assembly relative to the second container assembly, the third stacking feature of the second container assembly including a plurality of third raised areas and a plurality of third spaces formed between adjacent third raised areas, each of the first raised areas being adapted to be received by one of the third spaces so as to engage at least two of the third raised areas, and each of the third raised areas being adapted to be received by one of the first spaces so as to engage at least two of the first raised areas.

2. The container assembly of claim 1 wherein the first container and the second container are substantially identical.

3. The container assembly of claim 1 wherein the first and the second stacking features are substantially identical.

4. The container assembly of claim 1 wherein the first container and the second container are generally translucent.

5. The container assembly of claim 1 wherein the first and second stacking features include textured surfaces.

6. The container assembly of claim 5 wherein at least one of the textured surfaces is a random pattern.

7. The container assembly of claim 1 wherein the first container and the second container are made of polymeric material.

8. A method of stacking container assemblies, the method comprising the acts of:

providing a first generally polygonal container assembly including a first container and a second generally polygonal container, the first container having a first continuous body portion and a first rim, the first rim encompassing and projecting laterally outwardly from the first body portion, the first rim having a first rib feature projecting generally upwardly around about one-half of the perimeter of the first container, and a corresponding first groove feature extending around the remaining about one-half of the perimeter of the first container, the first body portion forming a first stacking feature thereon, the first stacking feature including a plurality of first raised areas and a plurality of first spaces formed between adjacent first raised areas, the first stacking feature being symmetrically disposed on the first container, the first stacking feature and the first rim being located on generally opposite ends of the first container, the second container including a second continuous body portion and a second rim, the second rim encompassing and projecting laterally outwardly from the second body portion, the second rim having a second rib feature projecting generally upwardly around about one-half of the perimeter of the second container, and a corresponding second groove feature extending around the remaining about one-half of the perimeter of the second container, the second body portion forming a second stacking feature thereon, the second stacking feature being symmetrically disposed on the second container, the second stacking feature and the second rim being located on generally opposite ends of the second container, the first rim and the second rim being substantially identical, the first container and the second container being releasably engaged to each other by fitting the first upwardly-projecting rib feature into the second groove feature of the second container and by fitting the second upwardly-projecting rib feature into the first groove feature of the first container;

providing a second container assembly including a generally polygonal third container and a fourth generally polygonal container, the third container having a third continuous body portion and a third rim, the third rim encompassing and projecting laterally outwardly from the third body portion, the third rim having a third rib feature projecting generally upwardly around about one-half of the perimeter of the third container, and a corresponding third groove feature extending around the remaining about one-half of the perimeter of the third container, the third body portion forming a third stacking feature thereon, the third stacking feature being symmetrically disposed on the third container, the third stacking feature and the third rim being located on generally opposite ends of the third container, the fourth container including a fourth continuous body portion and a fourth rim, the fourth rim encompassing and projecting laterally outwardly from the fourth body portion, the fourth rim having a fourth rib feature projecting generally upwardly around about one-half of the perimeter of the fourth container, and a corresponding fourth groove feature extending around the remaining about one-half of the perimeter of the fourth container, the fourth body portion forming a fourth stacking feature thereon, the fourth stacking feature including a plurality of fourth raised areas and a plurality of fourth spaces formed between adjacent fourth raised areas, the fourth stacking feature being symmetrically disposed on the fourth container, the fourth stacking feature and the fourth rim being located on generally opposite ends of the fourth container, the third rim and the fourth rim being substantially identical, the third container and the fourth container being releasably engaged to each other by fitting the third upwardly-projecting rib feature into the fourth groove feature of the fourth container and by fitting the fourth upwardly-projecting rib feature into the third groove feature of the third container;

positioning the first container assembly and the second container assembly such that the second and third containers are adjacent to each other; and engaging the first stacking feature of the first container assembly with the fourth stacking feature of the second container assembly to prevent or inhibit lateral movement of the first container assembly relative to the second container assembly, each of the first raised areas being received by one of the fourth spaces so as to engage at least two of the fourth raised areas, and each of the fourth raised areas being received by one of the first spaces so as to engage at least two of the first raised areas.

9. The method of claim 8 wherein the first, second, third, and fourth containers are substantially identical.

10. The method of claim 8 wherein the first, second, third, and fourth stacking features are substantially identical.

11. The method of claim 8 wherein the first, second, third, and fourth stacking features include textured surfaces.

12. The method of claim 11 wherein the respective textured surfaces are random.

13. The method of claim 8 wherein the first and third stacking features are substantially identical and the second and fourth stacking features are substantially identical.

14. The method of claim 8 wherein the first, second, third, and fourth containers are made of polymeric material.

15. A generally polygonal container comprising:

a continuous body portion;

a rim encompassing and projecting laterally outwardly from the body portion, the rim including a rib feature extending around about one-half of the perimeter of the container and a groove feature extending around the remaining about one-half of the perimeter of the container;

a first feature projecting generally upwardly from the rim;

a corresponding second feature positioned on the rim; and a stacking feature formed on the body portion opposite the rim, the stacking feature including a plurality of first raised areas, wherein the stacking feature is symmetrically disposed on the container, wherein the container is adapted to be stacked with a second container, the second container being inverted relative to the first container, by engaging each first raised area of the stacking feature of the container with at least two second raised areas of a second stacking feature of the second container to prevent or inhibit lateral movement of the container relative to the second container.

16. A container assembly comprising:

a first container including a first continuous body portion and a first rim, the first rim encompassing and projecting laterally outwardly from the first body portion, the first rim having a first rib feature projecting generally upwardly around about one-half of the perimeter of the first container, and a corresponding first groove feature extending around the remaining about one-half of the perimeter of the first container, the first body portion forming a first stacking feature thereon, the first stacking feature including a plurality of first raised areas, the first stacking feature and the first rim being located on generally opposite ends of the first container; and a second container including a second continuous body portion and a second rim, the second rim encompassing and projecting laterally outwardly from the second body portion, the second rim having a second rib feature projecting generally upwardly around about one-half of the perimeter of the first container, and a corresponding second groove feature extending around the remaining about one-half of the perimeter of the second container, the second body portion forming a second stacking feature thereon, the second stacking feature including a plurality of second raised areas, the second stacking feature and the second rim being located on generally opposite ends of the second container, wherein the first rim and the second rim are substantially identical, wherein the first container and the second container are releasably engaged to each other by fitting the first upwardly-projecting rib feature into the second groove feature of the second container and by fitting the second upwardly-projecting rib feature into the first groove feature of the first container, wherein the first and second stacking features are symmetrically disposed on the corresponding first and second containers, and wherein the container assembly is adapted to be stacked on a second container assembly by engaging each of the first raised areas of the first stacking feature of the container assembly with at least two third raised areas of a third a stacking feature of the second container assembly to prevent or inhibit lateral movement of the container assembly relative to the second container assembly.

17. The container assembly of claim 16 wherein the first container and the second container are substantially identical.

18. The container assembly of claim 16 wherein the first and the second stacking features are substantially identical.

19. The container assembly of claim 16 wherein the first container and the second container are generally translucent.

20. The container assembly of claim 16 wherein the first and second stacking features include textured surfaces.

21. The container assembly of claim 20 wherein at least one of the textured surfaces is a random pattern.

22. The container assembly of claim 20 wherein the first container and the second container are made of polymeric material.

* * * * *